US005565011A

United States Patent [19]

Follett et al.

[11] Patent Number: 5,565,011

[45] Date of Patent: Oct. 15, 1996

[54] ABRASIVE ARTICLE COMPRISING A MAKE COAT TRANSFERRED BY LAMINATION AND METHODS OF MAKING SAME

[75] Inventors: Gary J. Follett, St. Paul; Craig A. Masmar, Stillwater, both of Minn.; Jeffrey S. Peterson, Hudson, Wis.; Herb W. Schnabel, Midlothian, Va.

[73] Assignee: Minnesota Mining and Manufacturing Company, St. Paul, Minn.

[21] Appl. No.: 557,516

[22] Filed: Nov. 14, 1995

Related U.S. Application Data

[63] Continuation of Ser. No. 166,550, Dec. 14, 1993, abandoned, which is a continuation-in-part of Ser. No. 138,766, Oct. 19, 1993, abandoned.

[51] Int. Cl.[6] ..... B24D 11/00

[52] U.S. Cl. ..... 51/297; 51/298

[58] Field of Search ..... 51/293, 297, 295, 51/298, 307

[56] References Cited

U.S. PATENT DOCUMENTS

| | | | |
|---|---|---|---|
| 2,015,658 | 10/1935 | Bezzenberger | 51/278 |
| 2,548,872 | 4/1951 | Cross et al. | 117/17 |
| 2,658,007 | 11/1953 | Cross et al. | 117/17 |
| 3,176,437 | 7/1962 | Lanyon | 51/297 |
| 3,906,684 | 9/1975 | Murshall et al. | 51/296 |
| 4,035,961 | 7/1977 | Pemrick et al. | 51/295 |
| 4,047,903 | 9/1977 | Hesse et al. | 51/298 |
| 4,163,647 | 8/1979 | Swiatek | 51/295 |
| 4,311,489 | 1/1982 | Kressner | 51/298 |
| 4,588,419 | 5/1986 | Caul et al. | 51/295 |
| 4,652,274 | 3/1987 | Boettcher et al. | 51/298 |
| 4,652,275 | 3/1987 | Bloecher et al. | 51/298 |
| 4,735,632 | 4/1988 | Oxman et al. | 51/295 |
| 4,751,138 | 6/1988 | Tumey et al. | 428/323 |
| 4,799,939 | 1/1989 | Bloecher et al. | 51/293 |
| 4,903,440 | 2/1990 | Larson et al. | 51/298 |
| 4,927,431 | 5/1990 | Buchanan et al. | 51/298 |
| 4,930,266 | 6/1990 | Calhoun et al. | 51/293 |
| 4,985,340 | 1/1991 | Palazzotto et al. | 430/270 |
| 4,997,717 | 3/1991 | Rembold et al. | 478/413 |
| 5,089,536 | 2/1992 | Palazzotto | 522/16 |
| 5,137,542 | 8/1992 | Buchanan et al. | 51/295 |
| 5,175,965 | 1/1993 | Sanborn | 51/297 |
| 5,201,101 | 4/1993 | Rouser et al. | 24/575 |
| 5,203,884 | 4/1993 | Buchanan et al. | 51/295 |
| 5,236,472 | 8/1993 | Kirk et al. | 51/298 |
| 5,252,694 | 10/1993 | Wilett et al. | 525/404 |
| 5,256,170 | 10/1993 | Harmer et al. | 51/293 |
| 5,262,481 | 11/1993 | Jammett | 525/125 |
| 5,344,688 | 9/1994 | Peterson et al. | 428/102 |
| 5,436,063 | 7/1995 | Follett et al. | 428/224 |

FOREIGN PATENT DOCUMENTS

| | | | |
|---|---|---|---|
| 0465351A1 | 1/1992 | European Pat. Off. | C08G 18/54 |
| 0587171A1 | 3/1994 | European Pat. Off. | B24D 3/00 |

OTHER PUBLICATIONS

Klingspor Sanding Catalogue, pp. 8–9, 1994 vol. 17.

E. R. Kaswell, "Wellington Sears Handbook of Industrial Textiles", 1963, pp. 574–581 (no month).

ASTM D 1682—64 (Reapproved 1975)(no month).

*Primary Examiner*—Deborah Jones

*Attorney, Agent, or Firm*—Gary L. Griswold; Walter N. Kirn; Carolyn V. Peters

[57] ABSTRACT

Abrasive articles and a method of making the abrasive articles are provided wherein the method laminates a make coat precursor to atypical backing materials that include materials generally deemed inappropriate by those skilled in the art such as open-weave cloth, knitted fabrics, porous cloth, loop materials, untreated paper, unsealed fabrics, opened or closed cell foams, nonwovens, spun-fibers and the like.

19 Claims, 1 Drawing Sheet

ABRASIVE ARTICLE COMPRISING A MAKE COAT TRANSFERRED BY LAMINATION AND METHODS OF MAKING SAME

CROSS-REFERENCE TO RELATED APPLICATIONS

This is a continuation of application Ser. No. 08/166,550 filed Dec. 14, 1993, now abandoned, which is a continuation-in-part of Ser. No. 013/138,766, filed Oct. 19, 1993 now abandoned.

TECHNICAL FIELD

This invention relates to abrasive articles and a method of making abrasive articles, wherein a make coat precursor, independently formed is transferred to a backing material and abrasive grains are subsequently applied to the make coat side of the laminate.

BACKGROUND OF THE INVENTION

Coated abrasive articles generally comprise a flexible backing material having a coating of abrasive grains on one major surface thereof. Coated abrasive articles typically employ a make coat, for example, a resinous binder, in order to secure the abrasive grains to the backing material, and a size coat, for example, a resinous binder that is applied over the make coat and abrasive grains in order to firmly bond the abrasive grains to the backing material. Flexible backing materials can be cloth, paper, polymeric film, nonwoven materials, vulcanized fiber, and combinations thereof. Although cloth is widely used as a backing material because of strength, heat resistance, and flexibility, cloth has some major disadvantages.

Many known adhesive systems that have been used have low solids content requiring high input for drying and careful selection of backing materials. In the case of solvent-based adhesive, apparatus to extract solvent emissions may also be needed.

For example, cloth backing materials are generally porous, and have to be sealed or treated before a low viscosity make coat layer can be applied, thereby significantly adding to their cost (See, e.g. U.S. Pat. Nos. 2,548,872, 2,658,007 and 4,163,647). Cloth backing material is typically sealed by one or more treatment coats, such as a saturant coat, a presize coat, a backsize coat, or a subsize coat. Such coating saturates the cloth, and results in a stiffer cloth with more body. Alternatively, if the cloth is not previously sealed, the make coat will penetrate into the interstices of the cloth, making the backing material stiff and sometimes brittle, as well as, subsequently applied abrasive grains may not adhere well to the backing material.

In recent years, radiation curable resins have been proposed as cloth treatments or binders for coated abrasives as a substitute for conventional thermally curable resins (See U.S. Pat. No. 4,751,138 and U.S. Ser. No. 07/932,073), however many of these resins suffer the same disadvantages associated with liquid thermally cured liquid resins. Increasing the viscosity of the make coat, that is, increasing the solids content of the make coat, has been one approach to solving the problems associated with directly coating a make coat onto a porous backing material. For example, direct coating of high solid content make coats (such as, hot melt adhesive compositions) typically require elevated temperatures of the backing materials. Some backing materials exhibit such a high surface energy, that the make coat is drawn into the fibers of the backing material, again resulting in a stiff backing material.

SUMMARY OF THE INVENTION

In one aspect of the present invention an abrasive article is provided comprising:

(a) an atypical backing material having a front and back surface;

(b) a make coat layer transferred onto the front surface of the atypical backing material;

(c) a plurality of abrasive grains adhered to the make coat, wherein the make coat seals the front surface of the atypical backing material; and (d) optionally, a size coat overlying the abrasive grains and make coat.

The backing material need only be an atypical backing material, that is, a material generally excluded from consideration by those skilled in the art of abrasive articles because of processing problems generally associated with such backing materials. Such backing materials include open weave cloth, porous cloth, untreated paper, thin foam, knitted fabric, although it is preferred the backing material be cloth, more preferably a woven cloth. Atypical backing materials are generally less expensive, more readily available, and more flexible than typical backings, and prior to this invention, such atypical backings required expensive or timely pretreatment, such as saturation or pre-sizing to essentially make the backing material non-porous. Generally, pretreating an atypical backing material prior to adding an abrasive coating increases manufacturing cost, wastes resourses and raw materials and reduces the flexibility of the backing material.

In another aspect of the present invention, a method of preparing an abrasive article is provided comprising the steps:

(a) providing an atypical backing material having a front and back surface;

(b) providing a make coat precursor that has been independently formed to a non-flowable state at room temperature;

(c) laminating the make coat precursor to the front surface of the atypical backing material;

(d) applying a plurality of abrasive grains into the make coat precursor; and (e) curing make coat precursor to form a make coat.

The make coat precursor can be prepared using various techniques known to provide a transferable nonflowable integral film. Nonlimiting examples can include (1) a hot melt adhesive coated onto a release liner, or onto a carrier web to form a free standing film, (2) a solution coated film, or (3) an extruded free standing film. The make coat precursor, when coated, cast, extruded or otherwise formed into a film should be nonflowable and have sufficient integrity to be transferrable to a backing material.

The composition of the make coat precursor can contain, in addition to the make coat resins, catalysts or initiators, fillers and the like. If the make coat precursor does contain a catalyst or initiator, the catalyst or initiator can be activated at any point during the fabrication process. For example, activation of the catalyst or initiator can occur (1) after lamination, but before application of the abrasive particles, (2) after lamination and after application of the abrasive particles, (3) prior to lamination, or (4) after lamination, after application of the abrasive particles and simultaneously with the cure of the make coat precursor.

In another variation, a moisture curable make coat precursor can be laminated to the front surface of the backing material, the abrasive particles can be applied and the make coat precursor is exposed to moisture to effect curing.

While the method of this invention is preferably directed to a porous backing material having coverage of less than 90%, the method of the present invention can be used to fabricate an abrasive article using other atypical backing materials such untreated paper, fragile materials, or foamed materials, as well as, conventional nonporous or pretreated backing materials. Furthermore, any backing material that would ordinarily present a problem in the coating process can now be coated and be used to fabricate an abrasive article. Some coating problems that can be overcome by the process of the present invention include coating open weave materials without presizing, coating materials that may be temperature sensitive, coating materials that would otherwise be uncoatable, such as loop materials, foamed materials, untreated paper, knitted fabrics and the like.

The process of applying a make coat layer via lamination allows use of make coat formulations (high viscosity, solvent-based and the like) and/or backing materials (porous, fragile, open-weave and the like) that would normally present processing problems when fabricating an abrasive article. For example, lamination avoids elevating the temperature of the backing material to the temperature necessary to melt the make coat to a flowable state. This is particularly useful for temperature sensitive substrates.

Advantageously, the method of the present invention provides a means to coat a backing material, Utilize little or no volatile solvents, and tolerate higher make coat viscosities. The present invention provides a means to apply an abrasive coating to a porous backing material, without prior stabilization or handling of the backing material, thus improving the cost efficiency of abrasive article fabrication.

DESCRIPTION OF THE PREFERRED EMBODIMENTS

Figure 1A:
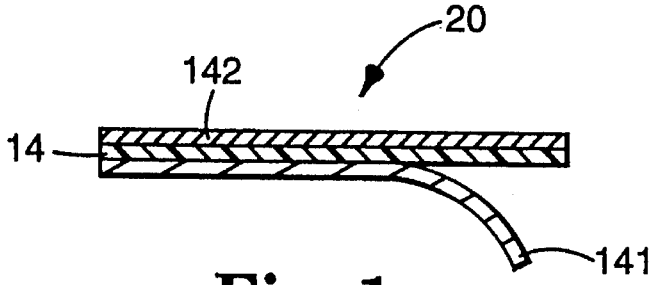
FIGS. 1*a* to 1*d* are a schematic representation of a method for preparing an abrasive article of the present invention and is represented in FIG. 1*d*.

The present invention describes a lamination process that advantageously allows the fabrication of abrasive articles using backing materials normally excluded by those skilled in the art of abrasives. Exclusion is generally based on processing problems, expense (both in terms of money, time and raw materials) of pretreating or the actual inability to overcome the fragility of the backing material contemplated.

Backing Materials

Atypical backing materials useful in the present invention have a front and back surface and include: many materials generally deemed inappropriate by those skilled in the art for fabricating abrasive articles, at least without some kind of pretreatment to seal or saturate the backing material. Examples of such useful atypical backing materials include open-weave cloth, knitted fabrics, porous cloth, loop material (general referred to as Velcro™ type materials), untreated paper, porous polymeric films, opened or closed celled foams (for example, polyurethane foams), nonwovens, spun-fibers, combinations thereof and any other material now known or may be known that is ordinarily excluded from consideration by those skilled in the art because of processing limitations, such as, make coat temperatures (backing material could melt or deform, permit excessive wicking of coatings), solvent susceptibility (solubilization of backing material, excessive penetration of coatings), porosity (seepage, excessive penetration of coatings, loss of flexibility), fragility, openness (seepage, wicking, inability to coat a sufficiently adhesive layer), stability (stretch or curl during processing) and the like.

While many of the backing materials used in the present invention may be used with other processes known to those skilled in the art, the atypical backings would need to be pretreated for use with conventional processes. There are some materials that cannot even be made psuedo suitable by pretreating. For example, open or closed cell foams are not porous per se, but rather have a textured surface, and may be temperature sensitive, such that the foam would be difficult to coat according to present methods known to those skilled in the art. Furthermore, the present invention has sufficient latitude to permit applying a make coat precursor to backings having a thickness in the range from 50 μm to 15 mm or more. The lamination process of the present invention makes no such distinction and can use virtually any backing material without pre-treatment, such as saturation or presizing.

Typically, cloth backing material is porous and has less than 90% coverage. Cloth backing material can be woven, knitted, stitchbonded, or weft-inserted. Yarns in the cloth backing material can be natural, synthetic or combinations thereof and can include polyester, cotton, rayon, nylon, aramid, glass and the like. Cloth backing material can be dyed and stretched, desized or heat stretched. Additionally, yarns in the cloth backing material can contain primers, dyes, pigments or wetting agents to the extent they do not inhibit the make coat cure. Furthermore, as the percent coverage decreases (in the range of 80% and even less than 80%), the process of the present invention is particularly advantageous as compared to direct coating processes known in the art.

Yarn sizes typically range from about 1500 to 12,000 m/kg. For a coated abrasive cloth backing, the weight of the greige cloth, that is, untreated cloth, ranges from about 0.15 to 1 kg/m$^2$, preferably between about 0.15 to 0.75 kg/m$^2$.

"Porous backing material" means a backing material not having an abrasive layer, a make coat, an adhesive layer, a sealant, a saturant coat, a presize coat, a materials, these openings will be between adjacent yarns. A porous backing backsize coat, etc. thereof and will have openings and in the case of cloth backing material has a Gurley porosity of less than 50 seconds when measured according to FTMS No. 191, Method 5452 (12/31/68) (as referred to in the *Wellington Sears Handbook of Industrial Textiles* by E. R. Kaswell, 1963 ed., p 575) using a Gurley Permeometer (available from Teledyne Gurley, Inc., Troy, N.Y.). The Gurley Permeometer measures the amount of time, in seconds, required for 100 cubic centimeters of air to pass through the backing material. This apparatus and procedures for its use are well known in the textile industry.

The ratio of fabric surface occupied by yarn to the total fabric surface is referred to as the fabric "cover factor" (C) or "% coverage". Standard fabric constructions of a greige fabric have fabric cover factors in the range of 80 to 95%. Alternatively, the air space in the fabric is on the order of 5 to 20%. The degree of openness will influence the penetration of coating into or through the fabric, and in part will affect adhesion of a make coat to the backing material.

Cover factor (C) can be calculated using the following equations (See U.S. Pat. No. 4,035,961, col 2, lines 25 to 42):

$$C = (C_w + C_f) - (C_w \times C_f) \times 100$$

$$C_w = [\text{Sley(ends/in)}]/[\sqrt{\text{WarpCount}} \times CCF]$$

$$C_f = [\text{Picks/In}]/[\sqrt{\text{FillingCount}} \times CCF]$$

wherein $C_w$=warp cover factor, $C_f$=filling cover factor and CCF=compact cover factor. For example, a fabric (2×1 twill) having 84×56 yarn counts, with a warp count=23/1 (100% Cotton) and a filling count=23/1 (100% Cotton):

$$C_w = 84/\sqrt{23} \times (28) = 0.626$$

$$C_f = 56/\sqrt{23} \times (16.8) = 0.695$$

$$\% C = (0.626 + 0.695) - (0.626 \times 0.695) = 88.6\%$$

Cloth backings of presently known coated abrasive articles require special treatments, such as a saturant coat, a presize coat, a backsize coat or a subsize coat to protect the cloth fibers, and to seal the backing. Coated abrasive articles according to the invention, however, require no such treatment, yet remain durable and flexible, although such treatments may be used, if desired.

The backing material may also have an attachment means on its back surface to secure the resulting coated abrasive to a support pad or back-up pad. This attachment means can be a pressure sensitive adhesive or a loop fabric for a hook and loop attachment. Alternatively, there may be an intermeshing attachment system as described in the assignee's U.S. Pat. No. 5,201,101 incorporated hereinafter by reference.

The back side of the abrasive article may also include a slip resistant or frictional coating and such coatings are known in the art. An example of such coatings include an inorganic particulate (e.g., calcium carbonate or quartz) dispersed in an adhesive. The backing material of this invention may also contain a backsize coating coated onto the back side of the backing material, that is, on the surface of the backing material opposite the abrasive coating. Generally, the backsize coating protects he backing material fibers from wear during abrading. This back wear can lead to fiber breakage and ultimately premature failure of the coated abrasive. Backsize coating typically comprises an adhesive material, such as glue, starch, phenolic resins, urea formaldehyde resins, acrylate resins, epoxy resins and combinations thereof. Backsize coating may also contain additives, such as fillers, dyes, pigments, coupling agents, wetting agents, antistatic agents and combinations thereof, and if used, are present in amounts consistent with their known and intended uses.

Make and Size Coat Layers and Compositions

A preferred make coat precursor comprises an optionally, temporary substrate coated with a nonflowable thermoplastic, such as a hot melt pressure sensitive adhesive, energy or moisture curable pressure sensitive adhesive or other PSA-like materials. The present invention can be used with any PSA or PSA-like make coat precursor provided the precursor is a film former prior to the lamination to the backing material. Once a film is formed, this nonflowable thermoplastic coating is transferred and laminated to a backing material, wherein the temporary substrate if any, is removed. The make coat precursor could also be a free standing film, such as an extruded film rather than a cast or roll-coated film. Once the make coat precursor is laminated to the backing material, abrasive particles can then be adhered to the thermoplastic make coat.

A make coat (a thermoplastic coating laminated to a backing material) serves to adhere a plurality of abrasive particles and seal the porous backing material. Using the make coat precursor of the present invention, the make coat can cover the interstices the backing material, that is, "bridge" the gaps in the backing material, without actually penetrating through the backing material. Further, the preferred make coat precursor should have sufficient adhesion to the backing material to prevent premature release of the abrasive particles during abrading. Finally, the preferred make coat precursor should have sufficient heat resistance and toughness to withstand heat build-up and forces associated with grinding.

Preferably, the 90° peel value between the make coat precursor and the backing material is typically at least 1.8 kg/cm, more preferably at least 2 kg/cm, because inadequate adhesion and weakness at the make coat-backing material interface will undoubtedly result in inferior performance particularly under dynamic conditions. If the 90° peel is too low, there is a greater tendency for abrasive particles to shell. This is, premature release of the abrasive particles.

Examples of used make and size coat compositions are known in the art and includes at least three classes of thermosetting resins, condensation curable, moisture curable, and addition polymerizable resins. The preferred coat composition precursors (also referred to as "precursors") are addition polymerizable resins because they are readily cured by exposure to radiation energy. Addition polymerizable resins can polymerize through a cationic mechanism or a free radical mechanism. Depending upon the precursor chemistry and the energy source utilized, a curing agent, initiator, or catalyst may be useful to initiate polymerization. Dry coating weights of the make and size coats can vary depending on the size of abrasive grains used and typically range from 4 g/m$^2$ to 310 g/m$^2$ for make coats and 12 g/m$^2$ to 550 g/m$^2$ for size coats.

Nonlimiting examples of precursors can include phenolic resins (e.g., resole and novolac, such as "Durez" from Occidential Chemical and "Aerofene" from Ashland Chemicals); acrylated urethanes (e.g., diacrylate esters of hydroxy-terminated extended polyesters or polyethers, such as, "Uvithane 782" from Morton International); acrylated epoxies (e.g., diacrylate esters of epoxy resins); ethylenically unsaturated compounds (e.g., esters of the reactions product of aliphatic monohydroxy or polyhydroxy groups and unsaturated carboxylic acid, such as, ethylene glycol diacrylate, ethylene glycol dimethacrylate, hexanediol diacrylate, methyl acrylate, ethyl acrylate); aminoplast derivatives having α, β pendant unsaturated carbonyl groups (e.g., those described in U.S. Pat. Nos. 4,903,440 and 5,236,472); isocyanurate derivatives having at least one pendant acrylate group and isocyanate derivatives having at least one pendant acrylate group (e.g., those described in U.S. Pat. No. 4,652,274); epoxy resins (e.g., diglycidyl ether of bisphenol A, cycloalphatic epoxies, and glycidyl ethers of phenol formaldehyde novolac); and mixtures and combinations thereof. The term "acrylate" encompasses acrylates and methacrylates.

A preferred make coat is a hot melt coatable pressure sensitive adhesive containing a component that can be energy-cured to provide a crosslinked coating after the make coat is applied to a backing material. The hot melt adhesive may not penetrate the interstices of the porous backing material, thereby preserving the natural flexibility and pliability of the backing material. The composition of the preferred make coat comprises an epoxy-containing material, a polyester component, and an effective amount of an initiator for energy curing. More particularly, the composition comprises from about 2 to 95 parts of the epoxy-containing material and correspondingly, from about 98 to 5 parts of the polyester component, as well as the initiator. An optional hydroxyl-containing material having a hydroxyl functionality greater than 1 may also be included.

Preferably, the polyester component has a Brookfield viscosity that exceeds 10,000 mPa at 120° C. with a number average Mw of about 7,500 to 200,000, more preferably from about 10,000 to 50,000 and most preferably from about 15,000 to 30,000. The polyester component may be the reaction product of (a) a dicarboxylic acid selected from the group consisting of saturated aliphatic dicarboxylic acids containing from 4 to 12 carbon atoms (and diester derivatives thereof) and aromatic dicarboxylic acids containing from 8 to 15 carbon atoms (and diester derivatives thereof) and (b) a diol having 2 to 12 carbon atoms.

Optional hydroxyl-containing material more preferably has a hydroxyl functionality of at least 2 and even more preferably a hydroxyl functionality of about 3. Particularly preferred materials are polyoxyalkylenes, such as polyoxyethylene glycols and polyoxypropylene glycols having a number average equivalent weight of about 31 to 2,250 and polyoxyethylene triols having a number average equivalent weight of about 80 to 350. Polyoxyalkylenes are especially preferred when the initiator is an aromatic sulfonium complex salt or an aromatic iodonium complex salt. Also useful is cyclohexane dimethanol, especially if the initiator is a metallocene Salt. The hydroxyl-containing material is useful in enhancing the flexibility of the make coat composition and can sufficiently retard the curing reaction after the make coat composition has been exposed to energy so as to permit abrasive particles to be adhered thereto.

Preferred make coat compositions are more fully described in co-pending application, U.S. Ser. No. 08/047,861, filed Apr. 15, 1993 assigned to the same assignee as the present application and such description is incorporated herein by reference.

Metallocene salt initiators useful for curing the preferred compositions are described in U.S. Pat. No. 5,089,536 and such description is incorporated herein by reference. It may be desirable for the metallocene salt initiators to be accompanied with an accelerator, such as an oxalate ester of a tertiary alcohol, although this is optional. The accelerator, if used, preferably comprises from about 0.1 to 4% of the make coat based on the combined weight of the epoxy-containing material and the polyester component, more preferably about 60% of the weight of the metallocene initiator. Useful commercially available initiators include FX-512, an aromatic sulfonium complex salt (3M Co.), UVE-1014, an aromatic sulfonium complex salt (Union Carbide Corp.) and Irgacure™ 261, a metallocene complex salt (Ciba).

For the monomer, and/or oligomers that polymerize via cationic addition polymerization, curing agents can include a salt having an onium cation and a halogen-containing complex anion of a metal or metalloid. Other cationic curing agents include a salt having an organometallic complex cation and a halogen-containing complex anion of metal or metalloid as described in U.S. Pat. No. 4,751,138 and such description is incorporated herein by reference. Another example of an curing agent is a mixture of an organometallic salt and an onium salt as described in U.S. Pat. No. 4,985,340 and such description is incorporated herein by reference.

When using free radical curable resins, it is often useful to add a free-radical initiator to the make coat precursor. However, in some cases, particularly when an electron beam is the energy source, a free radical initiator is not required because the electron beam will initiate and generate free radicals.

Examples of thermal initiators for free radical polymerization include peroxides, e.g., benzoyl peroxide, azo compounds, benzophenones, and quinones. For use with either ultraviolet or visible light energy source, free radical initiators can be photoinitiators, and include but are not limited to organic peroxides, azo compounds, quinones, benzophenones, nitroso compounds, aryl halides, hydrozones, mercapto compounds, pyrylium compounds, triarylimidazoles, bisimidazoles, chloroalkytriazines, benzoin ethers, benzil ketals, thioxanthones, and acetophenone derivatives, and mixtures thereof. Additional examples of photoinitiators are described in U.S. Pat. No. 4,735,632, and such description is incorporated herein by reference. The preferred initiator for use with visible light is Irgacure™ 369 commercially available from Ciba Geigy Corporation.

An example of an alternative make coat precursor is a moisture-cured hot melt polyurethane adhesive and suitable hot melt polyurethane adhesives are commercially available, for example, under the trade names Tivomelt 9617/11, 9628 and 9635/12 from Tivoli Werke, Hamburg, Germany; Purmelt Q.R116 and QR3310-21 from Henkei Adhesive Corp. and Jet Weld TS-230 from 3M Company. The polyurethane used in a given application will be selected according to particular requirements. As a general guide, polyurethanes having viscosities in the range of 3,000 to 12,000 mPa's (Brookfield) at 120° C. are suitable, but those exhibiting higher or lower values may be appropriate in certain circumstances. For example, a less viscous polyurethane will normally be required if a lower coating temperature is to be used, and a more viscous polyurethane may be suitable if a higher coating temperature can be tolerated.

Yet another example of a particularly useful make coat precursor is an epoxy and acrylate thermoplastic resin that has been partially cured to a B-stage state. Such compositions, as well, as the method for preparing such B-stage state resins have been described in U.S. Pat. No. 5,256,170 (Harmer et al.) and U.S. Pat. No. 5,252,694 (Willett et al.) assigned to the same assignee as the present application and such descriptions are, incorporated herein by reference. Preferably, the B-stage epoxy and acrylate precursors are fully cured acrylates with essentially uncured epoxy, which is post curable after lamination to a backing material.

An optional size coat can also be applied over the abrasive particles and the make coat. The purpose of the size coat is to further secure the abrasive particles to the make coat precursor. The size coat can be any type of adhesive and is preferably a resinous adhesive. Typical examples of size coats include hide glue, phenolic resins, aminoplast resins, urethane resins, epoxy resins, ethylenically unsaturated resins, acrylated isocyanurate resins, urea-formaldehyde resins, isocyanurate resins, acrylated urethane resins, acrylated epoxy resins, bismaleimide resins, fluorene modified epoxy resins and mixtures thereof. Depending upon the particular adhesive, the size coat may further include a catalyst or curing agent. The catalyst and/or curing agent will either help to initiate and/or accelerate polymerization.

Abrasive Particles

Abrasive particles typically have a particle size ranging from about 0.1 to 1500 micrometers, usually between about 0.1 to 400 micrometers, and preferably between 0.1 to 150 micrometers. It is preferred the abrasive particles have a Mohs' hardness of at least about 8, more preferably above 9. Examples of such abrasive particles include fused aluminum oxide (which includes brown aluminum oxide, heat treated aluminum oxide, and white aluminum oxide), ceramic aluminum oxide, green silicon carbide, silicon carbide, chromia, alumina zirconia, diamond, iron oxide, ceria, cubic boron nitride, boron carbide, garnet, and combinations thereof.

The term abrasive particles also encompasses when single abrasive particles are bonded together to form an abrasive agglomerate. Abrasive agglomerates are further described in U.S. Pat. Nos. 4,311,489; 4,652,275 and 4,799,939 and such descriptions are incorporated herein by reference.

It is also within the scope of this invention to have a surface coating on the abrasive particles. The surface coating may have many different functions. In some instances the surface coatings increase adhesion to the binder, alter the abrading characteristics of the abrasive particle and the like. Examples of surface coatings include coupling agents, halide salts, metal oxides including silica, refractory metal nitrides, refractory metal carbides and the like.

Abrasive particles may also be blended with diluent particles. The particle size of these diluent particles may be on the same order of magnitude as the abrasive particles. Examples of such diluent particles include gypsum, marble, limestone, flint, silica, glass bubbles, glass beads, aluminum silicate, and the like.

Additional Layers or Components

The make coat can further comprise optional additives, such as, for example, fillers (including grinding aids), fibers, lubricants, wetting agents, thixotropic materials, surfactants, pigments, dyes, antistatic agents, coupling agents, plasticizers, and suspending agents. The amounts of these materials are selected to provide the properties desired. Examples of useful fillers for this invention include: metal carbonates {such as calcium carbonate, (chalk, calcite, travertine, marble and limestone), calcium magnesium carbonate, sodium carbonate, magnesium carbonate}, silica (such as quartz, glass beads, glass bubbles and glass fibers) silicates (such as, talc), clays (such as, montmorillonite), feldspar, mica, calcium silicate, calcium metasilic ate, sodium aluminosilicate, sodium silicate, metal sulfates (such as, calcium sulfate, barium sulfate, sodium sulfate, aluminum sodium sulfate, aluminum sulfate), gypsum, vermiculite, wood flour, aluminum trihydrate, carbon black, metal oxides (such as, calcium oxide, aluminum oxide, titanium dioxide), and metal sulfites (such as, calcium sulfite).

Examples of antistatic agents include graphite, carbon black, vanadium oxide, humectants, conductive particles and the like. These antistatic agents are disclosed in U.S. Pat. Nos. 5,137,542 and 5,203,884 and such descriptions are incorporated herein by reference.

A coupling agent can provide an association bridge between the binder precursor and the filler particles or abrasive particles. Suitable coupling agents include silanes, titanates, and zircoaluminates. When a coupling agent is used, it is typically added to the make coat in the range of about 0.01 to 3% by weight.

An example of a suspending agent is an amorphous silica particle having a surface area less than 151 meters square/gram ($m^2/g$) that is commercially available from DeGussa Corp., under the trade name "OX-50".

A backsize coat may be applied to the back side of the backing material can add body to the backing material, as well as protecting the yarns of the cloth from wear.

Over the size coat may be applied an optional supersize coat. In some instances, the purpose of the supersize coat is to prevent the coated abrasive from loading. "Loading" is the term used to describe the filling of spaces between abrasive partictes with swarf (the material abraded from the workpiece) and the subsequent build-up of that material. For example, during wood sanding, swarf comprised of wood particles becomes lodged in the spaces between abrasive particles, dramatically reducing the cutting ability of the abrasive particles. Examples of such loading resistant materials include metal salts of fatty acids, urea-formaldehyde, waxes, mineral oils, fluorochemicals, crosslinked silanes, crosslinked silicones, fluorochemicals and combinations thereof. The preferred material is zinc stearate with an organic binder.

Alternatively, another supersize coating comprises a grinding aid dispersed in an adhesive. A grinding aid is a particulate material that the addition of which has significant effect on the chemical and physical abrading processes that results in improved performance when abrading metals such as stainless steel. In particular, it is believed in the art that a grinding aid will either (1) decrease the friction between the abrasive articles and the workpiece being abraded, (2) prevent the abrasive grain from "capping", that is, prevent metal particles from becoming welded to the tops of the abrasive articles, (3) decrease the interface temperature between the abrasive particles and the workpiece or (4) decrease the grinding forces. Examples of common grinding aids include waxes, organic halide compounds, halide salts and metals and their alloys. Preferred grinding aids include cryolite and potassium tetrafluoroborate. Supersize adhesives are typically the same adhesives as described above for the size coats.

Performance of Article

The process of the present invention is an advance in the art because atypical backing materials can be successful used in fabricating an abrasive article. The present invention eliminates wasteful sealing and presizing steps, which require additional raw materials and processing costs. The coated abrasive prepared according to the present invention is cost efficient while maintaining relatively high rates of cut and a relatively good surface on the workpiece being abraded. Such high rates of cut ("Cut") and good surface ("Finish") are generally associated with more conveniently prepared abrasive articles. Furthermore, the present invention provides make coat precursors that exhibit good adhesion to the backing material, for example, 90° peel adhesion can exceed 2 Kg/cm, and seal the backing material in excess of 500 seconds, as measured by a Gurley Permeometer.

Method of Making

In the process of the present invention, the make coat precursor is independently formed prior to lamination to the backing material. The resin of the make coat precursor is in a non-flowable state when it is laminated to a backing material. In some instances, it is preferred the make coat resin is coated onto a carrier web or between two carrier webs, both of which are eventually removed and reused or discarded. The make coat precursor is then laminated to the backing material, removing the carrier web(s) as necessary to form a resin/backing material interface. In many instances, a stronger bond may be formed by heating the precursor prior to lamination and then prior to application of the abrasive grains. The carrier web is a substrate or web like material having a front and back surface. The carrier web can be any suitable substrate material such as a textile, a nonwoven substrate, paper, polymeric film, treated versions thereof and combinations thereof. Preferred carrier webs are paper and polymeric film such as polyolefin films (polyethylene, polypropylene and the like) or polyester films. Additionally, the surface of the carrier web is such that after a make coat precursor is coated onto the web, it can easily be released. This surface may have sufficient releasability or may be coated with a release coating to permit easier release of the make coat precursor after it is formed.

Make coat precursors used in the present invention can be prepared in several ways. For example, the make coat precursor can be a hot melt adhesive in a thermoplastic state, that is, nonflowable at room temperature. Generally, hot melt adhesives described herein can be cured to thermosetting resins upon exposure to an appropriate energy source. Hot melt resin is generally heated to a point where the resin will flow. Flowable resin is then coated onto the front surface of a carrier web (temporary substrate) and allowed to cool. Hot melt make coats can be coated onto a carrier web by any conventional technique such as extrusion, die coating, slotted die coating, knife coating or combinations thereof. A preferred technique is to extrude hot melt through two carrier webs such that the hot melt make coat precursor is sandwiched between two carrier webs. After the hot melt make coat is coated onto a carrier web, it may be cooled or maintained at an elevated temperature.

In yet another alternative, a make coat precursor can be provided as a free standing film. For example, a hot melt adhesive can be coated at elevated temperature to a flowable state and onto a cooled chill roll to solidify to a nonflowable state. The hot melt make coat precursor is coated onto the chill roll by any conventional technique such as extrusion, die coating, slotted die coating, knife coating or combinations thereof. Alternatively, a free standing film could be extruded and then laminated onto a backing material.

In an alternative method, a make coat precursor can be coated onto a carrier web as a liquid and partially polymerized by exposing the precursor resin to an energy source. Partial polymerization (B-stage state) results in a make coat precursor being in a nonflowable state at room temperature, that is, prior to lamination.

A liquid make coat precursor can be coated onto a carrier web by any well-known techniques, such as roll coating, spraying, die coating, knife coating, dip coating, curtain coating and combinations thereof. Furthermore, a liquid make coat can be coated between two carrier webs, that is, the make coat precursor is sandwiched between two carrier webs.

Once the liquid make coat precursor has been coated, it may be converted to a nonflowable state. This conversion can be accomplished by several different techniques, depending upon the chemistry of the make coat precursor. For example, it is within the Scope of the invention to have a B-stage polymer dispersed in an organic solvent or water, that can be removed by any conventional technique, such as heating, to leave the B-stage polymer. Alternatively, a make coat precursor can be partially polymerized to a B-stage polymer. A make coat precursor (containing an appropriate catalyst or initiator) could be exposed to an energy source to help initiate partial polymerization of the make coat precursor. A preferred energy source is radiation energy, either ultraviolet or visible light.

It is also contemplated that a liquid make coat precursor may be comprised of more than one adhesive and/or a multi-component adhesive. For example, one of the components may he polymerized, while the other component is not. For example, the make coat precursor can comprise a blend of an epoxy resin, a cationic photoinitiator, an acrylate resin and a free radical photoinitiator. Exposing the liquid make coat precursor to light can activate either the cationic photoinitiator or the free radical photoinitiator.

Figure 1B:
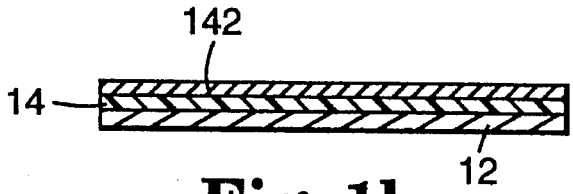
Figure 1C:
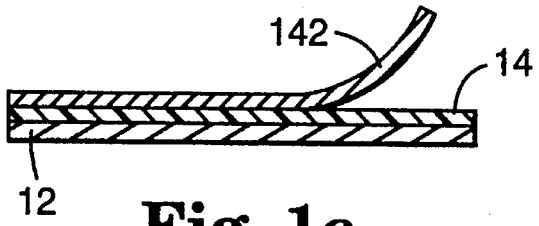
Figure 1D:
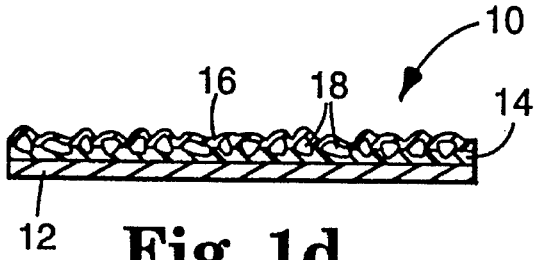

Referring to FIGS. 1(*a*) to 1(*d*), a general method of preparing the abrasive article (10) can be illustrated. Such a description is merely illustrative of one embodiment of the present invention and comprises the steps:

(a) providing a make coat precursor (20) comprising:
  (i) a layer of B-stage resin (14), which is a partially polymerized resin, (a non-flowable state at room temperature) between two releasable surfaces, such as a first and second carrier web (141 and 142);

(b) removing a first carrier web (141) and laminating the make coat precursor (20) to the front surface of an atypical backing material (12);

(c) removing a second carrier web (142) and exposing the make coat precursor (20) to an energy source;

(d) applying a plurality of abrasive grains (18) into the make coat precursor (20); and (e) curing make coat precursor (20) to form a make coat.

Further, a size coat (16) can be added to overlay the abrasive grains (18) and the make coat. The make coat precursor can be fabricated with only a single carrier web, when the flowable resin is coated onto a releasable drum and then laminated to the backing material. Thus, eliminating the first step of removing a first carrier web, as illustrated in FIG. 1.

In yet another aspect of the present invention, an alternative method is provided comprising the steps:

(a) providing an atypical backing material having a front and back surface;

(b) providing a make coat precursor by heating a hot melt resin to a flowable state, and coating a carrier web with the flowable hot melt resin;

(c) removing the carrier web and laminating the make coat precursor to the backing material;

(d) applying a plurality of abrasive particles into the make coat precursor; and (e) exposing the make coat precursor to a source of energy to polymerize the make coat precursor to form a make coat.

While the process of this invention is directed to an atypical backing material, it is possible to fabricate an abrasive article using this process and a nonporous backing material.

The nonflowable make coat precursor is transfer coated onto the front surface of the atypical backing. This transfer coating is accomplished by bringing the nonflowable make coat precursor into contact with the front surface of the atypical backing. Generally, pressure is applied on the make coat precursor to force it against the backing. In some instance, it may be preferred to apply heat during the transfer process. However, excess heat should not be applied to prevent premature polymerization of the make coat precursor and to prevent the make coat precursor from bleeding through the atypical backing. During this transfer coating process, the carrier web or webs are removed and then can be either reused or discarded.

The abrasive particles can be applied by any conventional technique such as drop coating or electrostatic coating. It is within the scope of this invention to heat the make coat precursor prior to the application of the abrasive particles such that the make coat precursor will better wet the abrasive particles. Again, excess heat should not be applied to prevent premature polymerization of the make coat precursor and to prevent the make coat precursor from bleeding through the atypical backing.

After the abrasive particles are applied, the make coat precursor can be cured either by exposure to an energy source to crosslink or polymerize the make coat precursor into a thermosetting make coat binder or by exposure it to moisture.

It is within the scope of all of these methods to have a size coat and optionally a supersize coating. These coatings are generally applied as liquids over the abrasive particles and then subjected to conditions to solidify the coating.

Energy Sources

When the make coat comprises a thermosetting binder precursor, the binder precursor is typically cured, upon exposure to an energy source. Examples of suitable energy sources include thermal energy and radiation energy. The amount of energy depends upon several factors such as the binder precursor chemistry, the dimensions of the make coat, the amount and type of abrasive particles and the amount and type of the optional additives. For thermal energy, the temperature can range from about 30° to 150° C., generally between 40° to 120° C. The time for polymerization can range from about 5 minutes to over 24 hours. Radiation energy Sources include electron beam, ultraviolet light, or visible light. Electron beam radiation can be used at an energy level of about 0.1 to about 10 Mrad. Ultraviolet radiation refers to non-particulate radiation having a wavelength within the range of about 200 to about 400 nanometers, preferably within the range of about 250 to 400 nanometers. It is preferred that 120 to 240 Watt/cm ultraviolet lights be used. Visible radiation refers to non-particulate radiation having a wavelength within the range of about 400 to about 800 nanometers, preferably in the range of about 400 to about 550 nanometers.

Objects and advantages of this invention are further illustrated by the following examples, but the particular materials and amounts thereof recited in these examples, as well as i other conditions and details, should not be construed to unduly limit this invention. All materials are commercially available or known to those skilled in the art unless otherwise stated or apparent.

EXAMPLES

All coating weights are specified in g/m$^2$. All formulation ratios are based upon parts by weight.

| Glossary | |
|---|---|
| DS1402 | a high molecular weight polyester with low crystallinity (commercially available from Hüls America under the trade designation 'Dynapol S1402') |
| EMI | a bisphenol A epoxy resin (commercially available from Shell Chemical under the trade designation 'Epon 828' - epoxy equivalent wt. of 185–192 g/eq) |
| EM2 | a bisphenol A epoxy resin (commercially available from Shell Chemical under the trade designation 'Epon 1001F' - epoxy equivalent wt. of 525–550 g/eq) |
| UFI | a urea-formaldehyde resin (commerically available from Borden, Inc. under the trade designation "Borden 8405") |
| CHDM | cyclohexanedimethanol |

-continued

| Glossary | |
|---|---|
| VOR | a polyol adduct of glycerol and propylene oxide (commercially available from Dow Chemical Company under the trade designation 'Voranol 230–238'-hydroxyl number of 38) |
| BA | n-butyl acrylate |
| IBA | isobornyl acrylate |
| POEA | phenoxyethyl acrylate |
| THFA | tetrahydrofurfuryl acrylate (commercially available from Sartomer under the trade designation 'SR-285') |
| KB-1 | 2,2-dimethoxy-1,2-diphenyl-1-ethanone (Irgacure ™ 651, commercially available from Ciba-Geigy, or KB-1 commercially available from Sartomer) |
| COM | $\eta^6$-[xylenes (mixed isomers)]$\eta^5$-cyclopentadienyliron(1+) hexafluoroantimonate |
| TSA | triphenyl sulfonium hexafluoroantimonate |
| AMOX | di-t-amyl oxalate |
| tBOX | di-t-butyl oxalate |
| FS | feldspar |
| WT | water |

The following test procedures were used to evaluate coated abrasive articles prepared according to the examples.

90° Peel Test

In order to measure the degree of adhesion between the backing material and the make coat of a coated abrasive article, the coated abrasive sheet to be tested was converted into a sample about 8 cm wide×25 cm long. One-half the length of a wooden board (17.78 cm×7.62 cm×0.64 cm thick) was coated with an adhesive. A portion of the coated abrasive sample (7.62 cm wide×15 cm long) was coated with an adhesive on the side bearing the abrasive material. In most instances, the adhesive was an epoxy resin with an appropriate curing agent. Then, the side of the sample bearing the abrasive material was attached to the side of the board containing the adhesive coating in such a manner that the 100 cm of the coated abrasive sample not bearing the adhesive overhung from the board. Pressure was applied such that the board and the sample were intimately bonded, and sufficient time was allowed for the adhesive to cure.

Next, the sample to be tested was scored along a straight line such that the width of the coated abrasive test specimen was reduced to 5.1 cm. The resulting coated abrasive sample/board composite was mounted horizontally in the lower jaw of a tensile testing machine having the trade designation 'SINTECH', and approximately 1 cm of the overhanging portion of the coated abrasive sample was mounted into the upper jaw of the machine such that the distance between jaws was 12.7 cm. The jaws were separated at a rate of 0.5 cm/sec, with the coated abrasive sample being pulled at an angle of 90° away from the wooden board so that a portion of the sample separated from the board. Separation occurred between the make coat and the cloth. The machine charted the force per centimeter of specimen width required to separate the cloth from the treatment coating. The higher the required force, the better adhesion of the make coat to the cloth backing material.

Some of the articles of the examples were tested for 90° peel adhesion. The force required to separate the treatment was expressed in kg/cm. The results arc set forth in Tables 2 and 4.

Breaking Load and Elongation

The coated abrasive backing or coated abrasive example to be tested was converted into a 2.5 cm by 17.8 cm strip. The strip was installed between the jaws of a tensile testing machine known under the trade designation "Sintech" so that the jaws were initially separated by a space of 5 cm. The jaws were pulled apart at a rate of 0.5 cm/sec. The machine direction (MD) strips were taken from the machine direction or the warp direction of the treated backing. The cross direction (CD) strips were taken in the cross direction or the vertical direction of the treated backing. The breaking load values were for the amount of force required to break the strip reported in units of kg/cm measured according to ASTM D 1682-64(1975). Additionally, the percent stretch (defined as [final length minus initial length]/initial length) of the sample was measured at a 45 kg load.

Disc Test Procedure

A coated abrasive article was converted into a 10.2 cm diameter disc and secured to a foam back-up pad with a pressure sensitive adhesive (PSA). The coated abrasive disc assembly was installed on a Schiefer testing machine and the coated abrasive disc abraded a 'PLEXIGLAS' (polymethyl methacrylate) ring having a 10.2 cm outer diameter and a 5.1 cm inner diameter. The load was 4.5 kg. All of the testing was done dry. The total amount of 'PLEXIGLAS' removed and the surface finish (Ra and Rtm) of the plexiglass workpiece were measured at various revolutions or cycles of the coated abrasive disc. 'Ra' is the arithmetic average of the scratch size in microinches. 'Rtm' is the average measured over five consecutive sampling lengths of the maximum peak to valley height in each sampling length. In some instances, the surface finish was not measured.

Rocker Drum Test Procedure

Preflexed coated abrasive articles were converted into 10.2×15.2 cm sheets. These samples were installed on a cylindrical drum of a Rocker Drum testing machine that oscillates (rocks) back and forth in a small arc creating a 1.3×10.1 cm wear path. The coated abrasive abraded a stationary 1.3×1.3×15.2 cm Type 3008F aluminum workpiece. There are approximately 20 strokes per minute on this wear path. The load applied to the workpiece via a lever arm was 2.7 Kg. The total amount of aluminum removed and the weight loss of the abrasive article(s) were measured at various total strokes of the aluminum workpiece.

EXAMPLES

EXAMPLES 1–3

A make coat precursor was prepared using the components and amounts summarized in Table 1.

This resin was applied at a weight of about 25 g/m$^2$ between two 100 μm thick release liners while irradiating with low intensity UV light from two sides resulting in a total dosage of 1000 mJ/cm$^2$. One liner was peeled off and the film was laminated (with a lamination pressure of 689 kPa) to a "J" weight cotton backing material that had been wetted and stretched. The cotton backing material was otherwise untreated. After removing the remaining liner, grade 120 fused aluminum oxide ('ALOX') was drop coated into the make coat precursor at a weight of about 209 g/m$^2$. The intermediate product was cured for 10 minutes at a temperature of 100° C. A size coat precursor was then roll-coated over the abrasive grains at a wet weight of about 109 g/m$^2$. The size coat precursor consisted of UF1 (6500 parts), FS (2100 parts), and aluminum chloride (452 parts, 10% solids in water), and WT (948 parts). The overall percentage of solids of the size coat precursor was 60%. The resulting intermediate product was heated for 45 minutes at a temperature of 66° C. After this thermal cure step, the resulting product was flexed prior to testing.

COMPARATIVE EXAMPLE C1

The coated abrasive article for Example C1 was a grade 80 "3M 311T Blue Grit" J weight utility cloth coated abrasive commercially available from Minnesota Mining and Manufacturing Company, St. Paul, Minn.

EXAMPLE 2

A make coat precursor was prepared according to formulation set forth in Table 1 above. The make coat precursor was applied at 125° C. by means of a die coater between two 100 μm thick release liners at a weight of about 84 g/m$^2$. One liner was peeled off and the film was laminated (lamination pressure of 689 kPa) to a "J" weight cotton backing material that had been wet and stretched. The cotton backing material was otherwise untreated. After removing the remaining liner, the resulting laminate was exposed to an ATEK type 'D' lamp running on its low setting which yields a lamp output of 160 Watts/cm of web width at a feed rate of 0.2032 m/sec. The lamps were positioned so that the make coat was exposed to ultraviolet light immediately before being coated with abrasive grains. Immediately afterwards, grade 80 fused ALOX was electrostatically projected into the make coat precursor at a weight of about 327 g/m$^2$. The intermediate product was thermally cured for 30 minutes at a temperature of 80° C. Then, a size coat precursor was roll-coated over the abrasive grains at a wet weight of about 159 g/m$^2$. The size coat precursor consisted of UF1 (6500 parts), FS (2100 parts), and aluminum chloride (452 parts, 10% solids in water), and WT (948 parts). The overall percentage of solids of the size coat precursor was 60%. The resulting intermediate product was heated for 45 minutes at a temperature of 66° C. After this thermal cure step, the resulting product was flexed prior to testing.

COMPARATIVE EXAMPLE C2

The coated abrasive article for Example C2 was a grade 80 "3M 311T Blue Grit" J weight utility cloth coated abrasive commercially available from Minnesota Mining and Manufacturing Company, St. Paul, Minn.

EXAMPLES 2 AND C2

The coated abrasive articles for this set of samples were evaluated using the Rocker Drum Test Procedure and the Disc Test Procedure with results summarized in Table 3.

TABLE 1

| Components (parts by weight) | Formulations | | |
|---|---|---|---|
| | Example 1 | Example 2 | Example 3 ("HSA 145") |
| BA | 35.8 | — | — |
| THFA | 23.9 | — | — |
| KB-1 | 0.3 | — | — |
| EM1 | 28.1 | 29.3 | 29.3 |
| EM2 | 7.0 | 29.9 | 29.9 |
| CHDM | 3.5 | 2.4 | 2.4 |
| COM | 0.7 | 1.0 | 0.8 |
| tBOX | 0.7 | — | — |
| AMOX | — | 0.6 | 0.6 |
| DS1402 | — | 40.4 | 40.4 |

Table 2 sets forth 90° Peel Adhesion Test results for the coated abrasive articles in Examples 1–2 and C1 and C2.

TABLE 2

| Examples | Force(Kg/cm) |
|---|---|
| C1 | 2.0 |
| 1 | 1.2 |
| C2 | 2.2 |
| 2 | 2.1 |

TABLE 3

| | Rocker Drum Test Procedure | | | Disc Test Procedure | |
|---|---|---|---|---|---|
| Examples | Abrasive Loss (g) | Total Cut (g) | Cycles | Total Cut (g) | % of Example C2 |
| C2 | 0.22 | 0.82 | 317 | 2.64 | 100 |
| 2 | 0.16 | 0.83 | 320 | 1.64 | 62 |

EXAMPLE 3

A resin blend was prepared using the components and amounts summarized in Table 1 (Herein after referred to as "HSA 145").

A make coat comprising DYNAPOL S 1402 (40.4 parts), EPON 828 (29.3 parts), EPON 1001F (29.9 parts), CHDM (2.4 parts), COM (1.0 part), and AMOX (0.6 part) was prepared by preheating the EPOM 828, the EPON 1001F, and the DYNAPOL 81402 in a suitable reaction vessel at 121° C. for 30 minutes. The CHDM was then added with mixing at 121° C. for 3 hours until a homogeneous melt blend was obtained. The temperature was then reduced to 100° C. and the AMOX and the COM were added with stirring at 100° C. for one hour.

The resin was knife-coated between two polyester release liners to a thickness of 4.5 mils (130 g/m$^2$). The resin was heated to 135° C. prior to coating and the coating knife was heated to 110° C., as was the knife bed. The film obtained was laminated to two backing materials.

The first backing material was a sample of cloth a 68×38 polyester/cotton blend, 2×1 twill (commercially available from Milliken Co.). The second backing material was a polyester "Hookit" backing material (a stitched loop backing commercially available from Milliken) with no other adhesives/sealants applied. The "Hookit" backing material was coated to determine whether the "Hookit" backing material could be coated/sealed. No other evaluation was performed on this sample but the result was that this very fragile, open backing material could be easily coated with this laminating adhesive and seal of the backing material was achieved. The adhesive coated backing materials were activated using a Fusion type "D" lamp at a power of 80 watts per cm at a line speed of 6.1 m/min, then drop coated with grade 80 ALOX. The samples were then oven cured at 80° C. for 5 minutes. This activation/cure process was common to all the examples to be presented except when otherwise noted. The finished samples held mineral aggressively but were not deemed appropriate for testing.

Further, laminating films were made at coating weights of 54 g/m$^2$ and 42 g/m$^2$. Processing as above indicated that the "Hookit" backing material, as well as the cloth backing material described could be well sealed at a coating weight of 54 g/m$^2$ but not at 42 g/m$^2$. Also, a sample of 32×28 poly/cotton fabric was lamination coated with a layer having a coating weight of 42 g/m$^2$. By visual inspection about 60% seal of the fabric was achieved.

The laminator used in these experiments had no means of measuring nip pressure but laminator air supply pressure was 276 kPa in every case in which the laminator was used. The laminator consisted of two stainless steel rolls, 5.1 cm diameter and 16.5 cm long. Laminator speed was about 1.5 m/min.

EXAMPLE 4

A laminating adhesive prepared from HSA 145 resin was coated at a coating weight of 85.4 g/m$^2$ by the process described in Example 3. This was laminated to standard "J" weight poly/cotton utility cloth backing material as above and submitted for 90° peel testing. The result was a 90° peel of 2.0 Kg/cm, compared to previous 90° peel results of 2.1 to 3.2 Kg/cm when the same adhesive was hot melt-coated directly onto the same cloth backing material.

EXAMPLE 5

An acrylate/epoxy resin blend was prepared as follows: by adding 60 parts acrylate phase, wherein tie acrylate phase was 90 parts POEA, 10 parts IBA and 0.5 parts KB-1 to 40 parts epoxy phase, wherein the epoxy phase was 94 parts EM-1, 2 parts COM and 2 parts AMOX.

The mixture was prepared by mixing the acrylates with KB-1 in a reaction vessel. To this mixture was added 66% of the EM-1 (62 parts). The mixture was purged with nitrogen for 15 minutes to remove residual dissolved oxygen. While rotating the reaction vessel, the mixture was irradiated with low intensity 420 nm fluorescent light (Sylvania F59.83 T12/SDB/SHO/LT, powered by 1500 mA inductive ballast). This partially converted the mixture to a higher viscosity (approximately 3000 cps as observed by visual appearance, not by viscometer).

A second mixture was prepared in the dark using the remaining EM-1 (32 parts), COM and AMOX by first heating the EM-1 to 80° C. and then adding COM and AMOX. Still in the dark, the second mixture (EM-1, COM and AMOX) was added to the acrylate/EM-1 mixture.

The blend was then knife-coated between two release liners to a thickness of 50 μm. The resulting film was cured under low intensity UV lamps (Sylvania F15 T8BLB lamps, powered by 720 mA inductive ballasts) for 10 minutes for a UV dosage of approximately 1000 mJ/cm$^2$.

The resulting cured film was laminated to a standard "J" weight backing as described above in Example i at a nip pressure of approximately 1.7 MPa. The laminated film was exposed to the Sylvania 420 nm lights described above for approximately 2 minutes. Abrasive grains were applied by drop coating 80 grade ALOX mineral at a coating weight of about 327 g/m$^2$. The coated article was then thermally cured at a temperature of 80° C. for approximately 5 minutes.

A size coat precursor was then roll-coated over the abrasive grains at a wet weight of about 159 g/m$^2$. The size coat precursor was prepared using UFI (6500 parts), FS (2100 parts), and aluminum chloride (452 parts, 10% solids in water), and WT (948 parts). The overall percentage of solids in the size coat precursor was 60%. The resulting intermediate product was heated for 45 minutes at a temperature of 66° C. After this thermal cure step, the resulting product was flexed prior to testing.

Samples as prepared above were tested for 90° peel, along with a comparative sample using the same backing material coated directly with the same adhesive blend. The result was that the laminated adhesive prepared according to the present invention gave a 90° peel value of 1.6 Kg/cm compared to the directly coated adhesive comparative example, which gave a 90° peel value of 1.9 Kg/cm.

EXAMPLE 6

A batch of the HSA 145 was made. Two layers of laminating adhesive were made as described above, at coating weights of 63 and 100 g/m$^2$. These were coated onto a series of cloth backing materials to determine which cloth backing materials could or could not be coated, and which ones gave acceptable 90° peel performance.

(1) 36×32 polyester/cotton blend, 63 g/m$^2$ make gave 90° peel=2.3 Kg/cm 100 g/m$^2$ make gave 90° peel=3.5 Kg/cm (2) 32×28 cotton, 63 g/m$^2$ make gave 90° peel=1.2 Kg/cm 100 g/m$^2$ make gave 90° peel=1.6 Kg/cm (3) 32×28 polyester/cotton blend, 63 g/m$^2$ make gave 90° peel=2.1 Kg/cm 100 g/m$^2$ make gave 90° peel=3.1 Kg/cm This example illustrates a thicker make coat gives better 90° peel adhesion, as well as illustrating adhesion is better to the more dense fabric. Surprisingly, the adhesion to poly/cotton Blends far exceeds adhesion to plain cotton fabric, leading to potential use of this resin system on pure polyester fabrics.

EXAMPLE 7

This example illustrates the process window for laminating the hot melt HSA 145 resin system to open weave fabric. A layer of HSA 145 (coating weight of 92 g/m$^2$) was prepared as above. This was laminated to two different backing materials over a range of laminator pressures, using a nip pressure 3.1 times the air gauge pressure. The results are as follows:

TABLE 4

90° Peel (Kg/cm) as a Function of Nip Pressure

| Pressures (kPa) | 36 × 32 Poly/cotton | 32 × 28 Poly/cotton |
|---|---|---|
| 207 | 2.3 | 2.3 |
| 414 | 2.2 | 2.5 |
| 621 | 2.2 | 2.6 |
| 828 | — | 2.5 |
| 1035 | 2.4 | 2.4 |
| 1242 | 2.3 | 2.4 |
| 1449 | 2.2 | — |

A control, 3M Blue Grit (Comparative Example C2) gave a 90° peel value of 2.1 Kg/cm.

The results indicated performance, as measured, is nearly independent of nip pressure over a wide range, leaving a very wide process window for this stage of the process.

All the 36×32 poly/cotton samples were well sealed but most of the 32×28 poly/cotton samples were poorly sealed, with no identifiable pattern with respect to laminating pressure. In contrast to the previous example, adhesion to 32×28 was better than to 36×32, although this is most likely within experimental error and still well in excess of target values. Break strength and elongation at break were also evaluated for this series of samples, and gave values of about 10.7 Kg/cm break and 18% elongation for the 36×32 samples and 10.2 Kg/cm break and 18% elongation for the 32×28 samples. This compares to Comparative Example C1 with break strength of 22.3 Kg/cm and elongation of 1.3%. The open weave backing material products, as expected, do not have the tensile strength of existing product.

EXAMPLE 8

A make coat precursor was prepared as follows:

| | |
|---|---|
| 90/10 PEA/IBA | 60 parts (prepared as described in Example 6) |
| EM1 | 40 parts |
| KB-1 | 1 part |
| COM | 1 part |
| AMOX | 0.6 parts |
| Hexanedioldiacrylate | 3 drops/100 g |

This was room temperature coated between two polyester release liners at a coating weight of 70 g/m$^2$ and low intensity UV-cured with a UV dose of 1000 mJ/cm$^2$. The resulting film was laminated to four different backing materials at 1.7 MPa nip pressure, (activation was already enacted during formation of the film since COM was present during UV cure of the acrylate phase) grade 80 ALOX mineral drop coated and ,heat cured as described above, and submitted for testing. The results are as follows:

| | |
|---|---|
| Standard "J" weight fabric | 1.4 Kg/cm |
| 36 × 32 poly/cotton fabric was too porous to test | |
| 32 × 28 poly/cotton fabric was too porous to test | |
| 32 × 28 cotton fabric was too porous to test | |
| Example C1 | 2.1 Kg/cm |

Break strength data was taken for this series also:

| | |
|---|---|
| Standard "J" weight fabric | 24.6 Kg/cm elong = 6.9% |
| 36 × 32 poly/cotton fabric | 9.6 Kg/cm, elong = 8.7% |
| 32 × 28 poly/cotton fabric | 10.7 Kg/cm elong = 13.6% |
| 32 × 28 cotton fabric | 7.3 Kg/cm elong = 1.4% |
| Example C1 | 22.3 Kg/cm elong = 1.6% |

Also, the samples were evaluated using a Rocker Drum Tests. The results are summarized as follows:

| | |
|---|---|
| Standard "J" weight fabric | 0.688 g cut in 293 cycles to fail |
| 36 × 32 poly/cotton fabric | 1.061 g cut in 437 cycles to fail |
| 32 × 28 poly/cotton fabric | 0.49 g cut in 188 cycles to fail |
| 32 × 28 cotton fabric | 0.843 g cut in 345 cycles to fail |
| Example C1 | 0.718 g cut in 308 cycles to fall |

The example shows performance not as good as examples using the HSA 145 formulation but exceeded Example C1 in some performance parameters.

EXAMPLE 9

A HSA 145 resin was prepared using a twin screw extruder operating at 125° C. at a screw speed at 100 RPM. This resin was coated between liners at a coating weight of 105 g/m$^2$, and was laminated to three different backing materials at a laminator nip pressure of 620 kPa. The results are summarized below:

TABLE 5

| Backing material | 90° Peel (Kg/cm) | Cut | Mineral Loss | Cycles to Fail |
|---|---|---|---|---|
| 36 × 32 (poly/cotton) | 3.7 | 1.952 | 0.095 | 903 |
| "J" weight (100% polyester) | 3.3 | 1.308 | 0.074 | 683 |
| "J" weight (100% cotton) | 2.2 | 1.373 | 0.050 | 642 |
| Example C1 | 1.8 | 0.726 | 0.270 | 308 |

This data shows performance that exceeds existing product performance in every way, and by a large amount. Also, it is indicated adhesion to polyester is significantly better than to cotton backing materials. This is a good result because polyester backing material S tend to be stronger in tensile values compared to equivalent weight of cotton.

EXAMPLE 10

A make coat precursor was coated onto a release liner and then laminated to various backing materials. The HSA 145 resin system was used, and was compounded using a single screw extruder operating at 88° C. with a screw speed of 100 RPM. The resin produced was coated onto release liner using an extrusion slot die from which was coated at a web speed of 9.1 m/min. and the process was set to deliver a finished coating weight of 105 g/m$^2$. Mesurements made on cured portions of films indicated that the coating weight was 105 g/m$^2$ for 36×32 poly/cotton, 32×28 poly/cotton and "J" weight cotton backing materials were nip roll laminated on line with the adhesive film above.

Cloth samples from the above run were subsequently mineral coated by removing the release liner, UV activating under a Fusion type "D" lamp operating at 118 W/cm at a line speed of 18.3 m/min, electrostatic mineral coating with grade 80 ALOX, and heat curing in a back rack oven at 80° C. for 30 minutes. The resulting samples were porous to the point that sizing was problematic.

EXAMPLE 11

To ascertain the cause of the porosity problem in Example 10, a series of UV dosage versus porosity was carried out at two different wavelengths of UV activating energy. Using HSA 145 resin prepared on the twin screw extruder, as described in Example 8, laminating film was coated between release liners at a coating weight of 102 g/m$^2$. This was laminated to a 32×28 poly/cotton fabric backing material at 689 kPa nip pressure.

The make coats thus produced were activated under a Fusion "D" lamp operating at 80 W/cm and a Fusion "V" lamp operating at 80 W/cm over a series of line speeds ranging from 3.1 m/min to 21.3 m/mins, and each sample was oven cured at 80° C. for 7 minutes—a point at which any flow that was going to occur would be complete. The trend of porosity as measured by the Gurley porosity tester versus UV dosage was examined.

It was noted that, as UV activation of the epoxy catalyst is increased by longer exposure to the light, the porosity of the finished heat cured product decreases. This is due to the fact that, with increased activation of the epoxy catalyst, cure of the epoxy occurs before significant flow of the make coat into the cloth backing material has a chance to occur. Thus bridging of the interstices between the threads is maintained and cloth seal is accomplished.

It was also noted that the use of a Fusion type "V" lamp yields a dramatic improvement in the sealing of the cloth backing material at any given line speed. This is due to the fact that the "V" lamp, whose output is centered at 420 nm, more effectively activates the epoxy photoinitiator whose absorption spectrum centers at 420 nm.

EXAMPLE 12

A laminating adhesive prepared from HSA 145 resin (Example 3) was heated to 135° C. and knife coated at a coating weight of 125 g/m$^2$ between two polyester release liners. After cooling, one release liner was stripped off and the hot melt material laminated to an open cell polyurethane ester foam having a density of 92±5 kg/m$^3$ and a thickness of 5 mm. The second release liner was stripped off and the resultant foam/hot melt laminate construction was passed under a 240 W/cm Fusion lamp at 6.1 m/min in order to activate the catalyst. Grade 60 ALOX mineral was drip coated at a weight of approximately 460 g/m$^2$. This construction was cured at 90° C. for one hour. Subsequently, this construction was spray sized with Witcobond W-240 (a polyurethane at 30% solids from Witco) at an approximately dry weight of 209 g/m$^2$. The abrasive article was then oven dried at 90° C. for three hours.

COMPARATIVE EXAMPLE C3

The abrasive article for Example C3 was Medium Grade 3M Softback Sanding Sponge commercially available from Minnesota Mining and Manufacturing Company, St. Paul, Minn.

| Examples | Disc Test Procedure Total Cut (g) | % of Example C3 |
|---|---|---|
| C3 | 0.58 | 100 |
| 12 | 1.18 | 203 |

Various modifications and alterations of this invention will become apparent to those skilled in the art without departing from the scope and principles of this invention, and it should be understood that this invention is not to be unduly limited to the illustrative embodiments set forth hereinabove. All publications and patents are herein incorporated by reference to the same extent as if each individual publication or latent was specifically and individually indicated to be incorporated by reference.

What is claimed:

1. An abrasive article comprising:

(a) a loop backing material having a from and back surface, wherein the loop backing material is untreated and unsealed;

(b) a make coat layer laminated onto the front surface of the loop backing material; and (c) a plurality of abrasive grains adhered to the make coat, wherein the make coat seals the front surface of the loop backing material.

2. The abrasive article according to claim 1 wherein the loop backing material has a Gurley porosity of less than 50 seconds when measured according to FTMS N. 191, Method 5452 (12/31/68) prior to lamination of the make coat layer.

3. The abrasive article according to claim 1 wherein the make coat layer is selected from the group consisting of phenolic resins, aminoplast resins having pendant α,β-unsaturated carbonyl groups, urethane resins, epoxy resins, acrylate resins, acrylated-isocyanurate resins, polyurethanes, urea-formaldehyde resins, polyesters, isocyanurate resins, acrylated-urethane resins, acrylated-epoxy resins and mixtures thereof.

4. The abrasive article according to claim 1 wherein the make coat layer is a hot-melt coatable pressure sensitive adhesive containing an energy curable component.

5. The abrasive article according to claim 1 further including a backsize coating on the back surface of the loop backing material.

6. The abrasive article according to claim 1 further comprising a size coat overlying the make coat layer and plurality of abrasive particles.

7. The abrasive article according to claim 6 wherein the size coat is selected from the group consisting of phenolic resins, aminoplast resin having pendant α,β-unsaturated carbonyl groups, polyester, urethane resins, epoxy resins, acrylate resins, acrylated-isocyanurate resins, urea-formaldehyde resins, polyurethanes, isocyanurate resins, acrylated-urethane resins, acrylated-epoxy resins and mixtures thereof.

8. The abrasive article according to claim 7 further comprising a supersize coat overlying the size coat.

9. The abrasive article according to claim 7 wherein the supersize coat comprises zinc stearate with an organic binder.

10. A method for making an abrasive article comprising the steps:

(a) providing loop backing material having a front and back surface, wherein loop backing material is untreated and unsealed;

(b) providing a make coat precursor that has been independently cured to a non-flowable state at room temperature;

(c) laminating the make coat precursor to the front surface of the loop backing material;

(d) applying a plurality of abrasive grains onto the make coat precursor; and (e) curing the make coat precursor.

11. The method according to claim 10 wherein the make coat precursor is a hot melt coatable, pressure sensitive adhesive coated onto a release liner.

12. The method according to claim 10 wherein the make coat precursor is a solution coated, free standing film.

13. The method according to claim 10 wherein the make coat precursor is an extruded free standing film.

14. The method according to claim 10 wherein the make coat precursor is a moisture cured polyurethane.

15. The method according to claim 10 wherein the make coat precursor contains an energy activated initiator.

16. The method according to claim 15 further including activating the energy activated initiator (1) prior to the laminating step, (2) after the laminating step but prior to application of the abrasive particles, or (3) after applying the abrasive grains.

17. The method according to claim 10 further including applying pressure to the make coat precursor simultaneously while laminating the make coat precursor to the loop backing material.

18. The method according to claim 10 further including applying pressure to the make coat precursor after laminating the make coat precursor to the loop backing material.

19. The method according to claim 10 further comprising the step of applying a size coat precursor over the plurality of abrasive grains and the make coat.

* * * * *

UNITED STATES PATENT AND TRADEMARK OFFICE

CERTIFICATE OF CORRECTION

PATENT NO. : 5,565,011

DATED : October 15, 1996

INVENTOR(S) : Gary J. Follett, Craig A. Masmar, Jeffrey S. Peterson, Herb W. Schnabel It is certified that error appears in the above-identified patent and that said Letters Patent is hereby corrected as shown below:

Col. 4, lines 45 through 48, replace

"sealant, a saturant coat, a presize coat, a materials, these openings will be between adjacent yarns. A porous backing backsize coat, etc. thereof and will have openings and in the case of cloth backing material has a Gurley" with – sealant, a saturant coat, a presize coat, a backsize coat, etc. thereon and will have openings and in the case of cloth backing materials, these openings will be between adjacent yarns. A porous backing material has a Gurley –

Col. 6, line 24, replace "used" with – useful –

Col. 12, line 14, replace "(a)" with – (b) – and insert on the line before:

-- (a) providing an atypical backing material (12) having a front and back surface; --

Col. 12, lines 19 -20, replace "(b) removing a first carrier web (141) and laminating the make coat precursor (20) to the front surface of an" with – (c) removing a first carrier web (141), if present, and laminating the make coat precursor resin (14) to the front surface of the –

Col. 12, line 22, replace "(c)" with –(d) –

Col 12, line 23, replace "make coat precurson (20) to an energy source;" with – make coat precursor resin (14) to an energy source; --

Col. 12, line 24, replace "(d)" with – (e) –

Col. 12, line 25, replace "make coat precursor (20);" with – make coat precursor resin (14) –

Col. 12, line 26, replace "(e) curing make coat precursor (20)" with – curing make coat precursor resin (14) –

Col. 17, line 31, replace "8" with – S –

Col. 21, line 59, replace "complete." With – completed. –

UNITED STATES PATENT AND TRADEMARK OFFICE

CERTIFICATE OF CORRECTION

PATENT NO. : 5,565,011

DATED : October 15, 1996

INVENTOR(S) : Gary J. Follett, Craig, A. Masmar, Jeffrey S. Peterson, Herb W. Schnabel It is certified that error appears in the above-identified patent and that said Letters Patent is hereby corrected as shown below:

In the claims:

Col. 22., line 53, replace "from" with – front --

Signed and Sealed this

Twenty-first Day of March, 2000

*Attest:*

*Attesting Officer*

Q. TODD DICKINSON

*Commissioner of Patents and Trademarks*